US009108446B2

(12) United States Patent
Nishioka et al.

(10) Patent No.: US 9,108,446 B2
(45) Date of Patent: Aug. 18, 2015

(54) INK JET PRINTING APPARATUS AND INK JET PRINTING METHOD

(75) Inventors: Shingo Nishioka, Yokohama (JP); Eiji Komamiya, Kawasaki (JP); Mitsutoshi Nagamura, Tokyo (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/455,450

(22) Filed: Apr. 25, 2012

(65) Prior Publication Data

US 2012/0287203 A1 Nov. 15, 2012

(30) Foreign Application Priority Data

May 10, 2011 (JP) ..... 2011-105242

(51) Int. Cl.
*B41J 19/14* (2006.01)

(52) U.S. Cl.
CPC ..... *B41J 19/142* (2013.01)

(58) Field of Classification Search
CPC ..... B41J 2/2132; B41J 19/142; B41J 19/147; B41J 2/15; B41J 2/04551; B41J 11/425; B41J 2002/17569; B41J 2/2056
See application file for complete search history.

(56) References Cited

U.S. PATENT DOCUMENTS

| | | | | |
|---|---|---|---|---|
| 6,250,737 | B1 * | 6/2001 | Matsubara et al. | 347/40 |
| 6,474,779 | B2 * | 11/2002 | Inui et al. | 347/43 |
| 6,517,192 | B2 * | 2/2003 | Kaneko et al. | 347/43 |
| 8,376,495 | B2 | 2/2013 | Yamazaki et al. | |
| 2003/0016261 | A1 * | 1/2003 | Nitta et al. | 347/15 |
| 2010/0141699 | A1 | 6/2010 | Yamazaki et al. | |
| 2012/0154469 | A1 * | 6/2012 | Komamiya et al. | 347/14 |

FOREIGN PATENT DOCUMENTS

| | | | |
|---|---|---|---|
| JP | 6-24007 | A | 2/1994 |
| JP | 3176130 | B2 | 4/2001 |
| JP | 2001-301144 | A | 10/2001 |
| JP | 2010-131841 | A | 6/2010 |

* cited by examiner

*Primary Examiner* — Justin Seo
(74) *Attorney, Agent, or Firm* — Fitzpatrick, Cella, Harper & Scinto

(57) ABSTRACT

Even if colors are printed in the same order for each band, time difference unevenness is suppressed which results from a difference in duration from the end of the first scan until the beginning of the second scan. An ink jet printing apparatus completely prints a scan area with a width corresponding to a predetermined length of a nozzle line. The ink jet printing apparatus includes conveying means for moving the print medium, generation means for generating print data in such a manner that in the two scans for completely printing the scan area with the width corresponding to the predetermined length, a print duty for the first scan is higher than a print duty for the second scan, and print control means for carrying out the first scan in an identical direction for all the scan areas completely printed by the two scans.

26 Claims, 18 Drawing Sheets

INK JET PRINTING APPARATUS AND INK JET PRINTING METHOD

BACKGROUND OF THE INVENTION

1. Field of the Invention

The present invention relates to an ink jet printing method, and in particular, to an ink jet printing apparatus and an ink jet printing method in which a predetermined area is printed by two reciprocating scans.

2. Description of the Related Art

In some ink jet printing apparatuses for color printing, print heads that eject a cyan ink, a magenta ink, and a yellow ink, respectively, are arranged in a main scanning direction. It is assumed that these print heads are used to carry out reciprocating 2-pass printing. Then, when the magenta ink and the yellow ink are focused on, during the first forward scan, the nozzles in the lower half of each relevant print head are used to print an image at a duty of about 50% so that the yellow ink and then the magenta ink are printed. Then, the sheet is fed by a length equal to the half of the width of the print head. Then, during the second backward scan, the nozzles in the upper half of each relevant print head are used to print an image at a duty of about 50% so that the yellow ink and then the magenta ink are printed. The first and second reciprocating scans allow one band with a width equal to the half of the print head width to be completely printed. In one band in such printing, printing is carried out in the following order: magenta, yellow, yellow, and magenta. In the adjacent band, printing is carried out in the following order: yellow, magenta, magenta, and yellow. As a result, the resultant color may vary among bands each completed by two-pass printing depending on the first ink used for printing.

A printing method is known in which the ink colors are printed is in the same order in order to reduce the above-described difference in color among the bands depending on the order of printing of the colors (for example, refer to Japanese Patent No. 3176130). In this printing method, conveyance of a print medium following a forward print scan differs, in direction and amount, from conveyance of the print medium following a backward print scan so as to allow the ink colors to be printed in the same order. This reduces the variation in color among the bands.

In the printing method described in Japanese Patent No. 3176130, the first band is completely printed by the first scan and the second scan, whereas the second band is completely printed by the first scan and the fourth scan. Thus, the first band and the second band vary in the duration from the end the first scan until the beginning of the second scan during the two passes for printing the band. Such a time difference may lead to time difference unevenness among the bands.

SUMMARY OF THE INVENTION

The present invention has been developed in view of the above-described points. An object of the present invention is to provide an ink jet printing apparatus and an ink jet printing method which enable suppression of time difference unevenness resulting from a difference in the duration from the end of the first scan until the beginning of the second scan even with the use of the same order of printing colors for all the bands.

To accomplish this object, the present invention provides an ink jet printing apparatus for forming an image area on a print medium by scanning a nozzle array in a forward direction and a backward direction, said nozzle array comprising a plurality of nozzles that are for ejecting ink and that are arranged in a predetermined direction, said image area having a width in the predetermined direction that corresponds to a predetermined length of said nozzle array, said forward direction and said backward direction crossing said predetermined direction, the apparatus comprising: print control means for carrying out the printing of an adjacent 2 of said image areas, wherein in said printing after performing scanning in the forward direction for said 2 adjacent image areas at different times, scanning in the backward direction is performed while straddling said 2 adjacent image areas; and generation means for generating print data in such a manner that print duty while performing said scanning in the forward direction is higher than print duty while performing said scanning in the backward direction.

According to the above-described configuration, in a printing method for printing a predetermined area by two scans, if colors are printed in the same order for each area, the print duty for the first scan is set higher than that for the second scan. This allows time difference unevenness to be suppressed even if the duration from the end of the first scan until the beginning of the second scan varies among the bands.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

(First Embodiment)

Figure 1A:
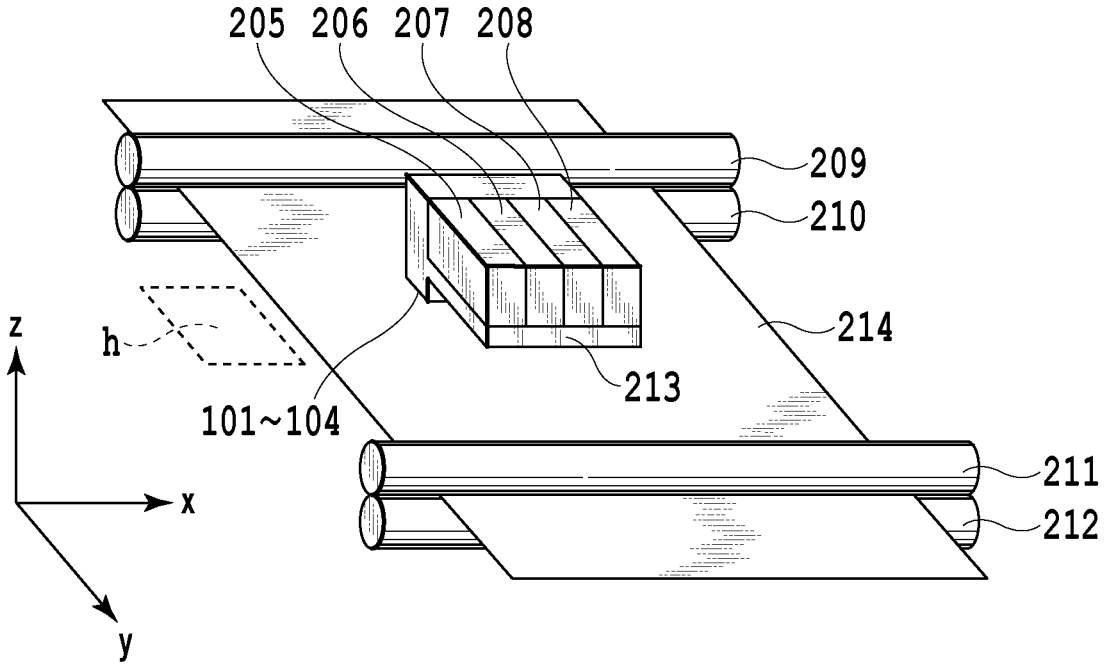
FIGS. 1A and 1B are diagrams showing a printing apparatus and print heads according to a first embodiment.
Figure 1B:
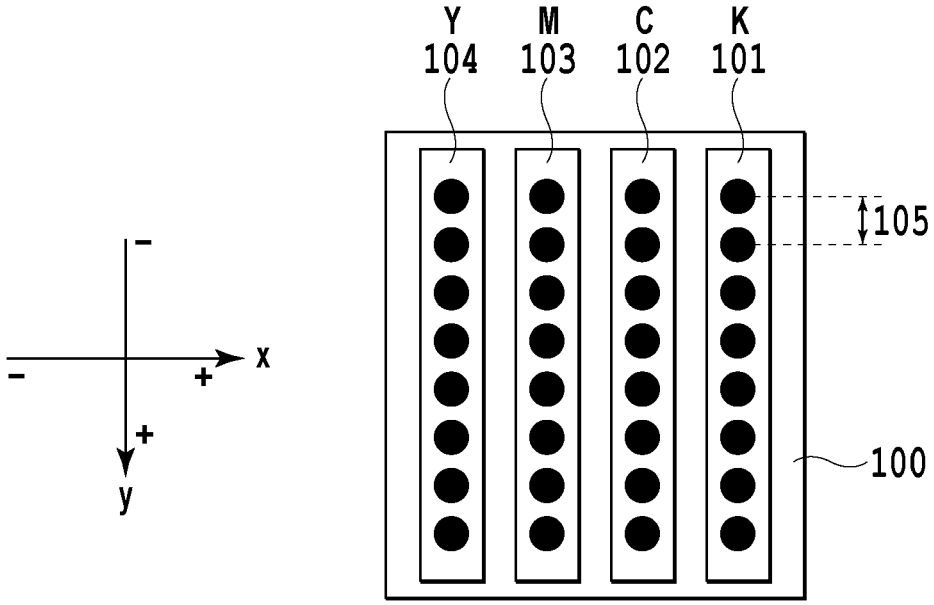

FIG. 1A is a schematic perspective view showing an ink jet printing apparatus according to the present embodiment. FIG. 1B is a diagram showing a print head according to the preset embodiment.

In the printing apparatus according to the embodiment shown in FIG. 1A, four inks in black (K), cyan (C), magenta (M), and yellow (Y) are accommodated in ink tanks 205 to 208, respectively. The four inks are supplied to print heads 101 to 104.

In FIG. 1B, filled-in circles represent ejection ports through which ink droplets are ejected. Eight nozzles are arranged in a y direction. The print head 101 includes a nozzle line from which the black ink is ejected. The print head 102 includes a nozzle line from which the cyan ink is ejected. The print head 103 includes a nozzle line from which the magenta ink is ejected. The print head 104 includes a nozzle line from which the yellow ink is ejected.

Conveying rollers 209 and 210, together with auxiliary rollers 211 and 212, roll while pinch a print medium such as a print sheet to convey the print medium, and also serve to hold the print medium. A carriage 213 includes ink tanks 205 to 208 and the print heads 101 to 104 mounted thereof. The carriage 213 moves along an X direction in a reciprocating manner, while the ink is ejected from the print heads to print an image on the print medium.

During non-printing operations of the print heads 101 to 104 such as a recovery operation, the carriage 213 is controlled to stand by at a home position h shown by a dotted line in FIG. 1A. When a print start instruction is input, the print heads 101 to 104 standing by at the home position h moves in the X direction in FIG. 1A together with the carriage 213, while ejecting the ink onto the print medium 214 to print an image on the print medium 214. One motion (scan) of the print head allows printing of an area with a width corresponding to the range of arrangement of ejection ports in the print heads 201 to 204.

When printing with one scan of the carriage 213 in a main scanning direction (positive X direction) ends, the carriage 213 allows the print heads 201 to 204 to carry out printing while scanning the print medium in the opposite direction (negative X direction). After the last printing scan ends and before the subsequent print scan is started, the conveying rollers 209 and 210 roll to convey the print medium in a nozzle arrangement direction (sub-scanning direction, Y direction) crossing the main scanning direction. Thus, the print scan of the print heads and the conveyance of the print medium are repeated to complete printing the image on the print medium 214. That is, the scan area with the width corresponding to a predetermined length of a nozzle line is completely printed by two scans by carrying out a forward scan and a backward scan in the direction in which the nozzle lines are arranged and between the forward scan and the backward scan, moving the print medium relative to the print heads in the direction in which the nozzles in the nozzle lines are arranged. A printing operation of ejecting the ink from the print heads 201 to 204 is performed under the control of control means described below.

In the present embodiment, the print heads and the ink tanks are mounted on the carriage so as to be separable. However, a cartridge on which the print heads and the ink tanks are integrated together may be mounted on the carrier. Alternatively, a single print head that can eject a plurality of color inks may be mounted on the carriage.

Figure 2:
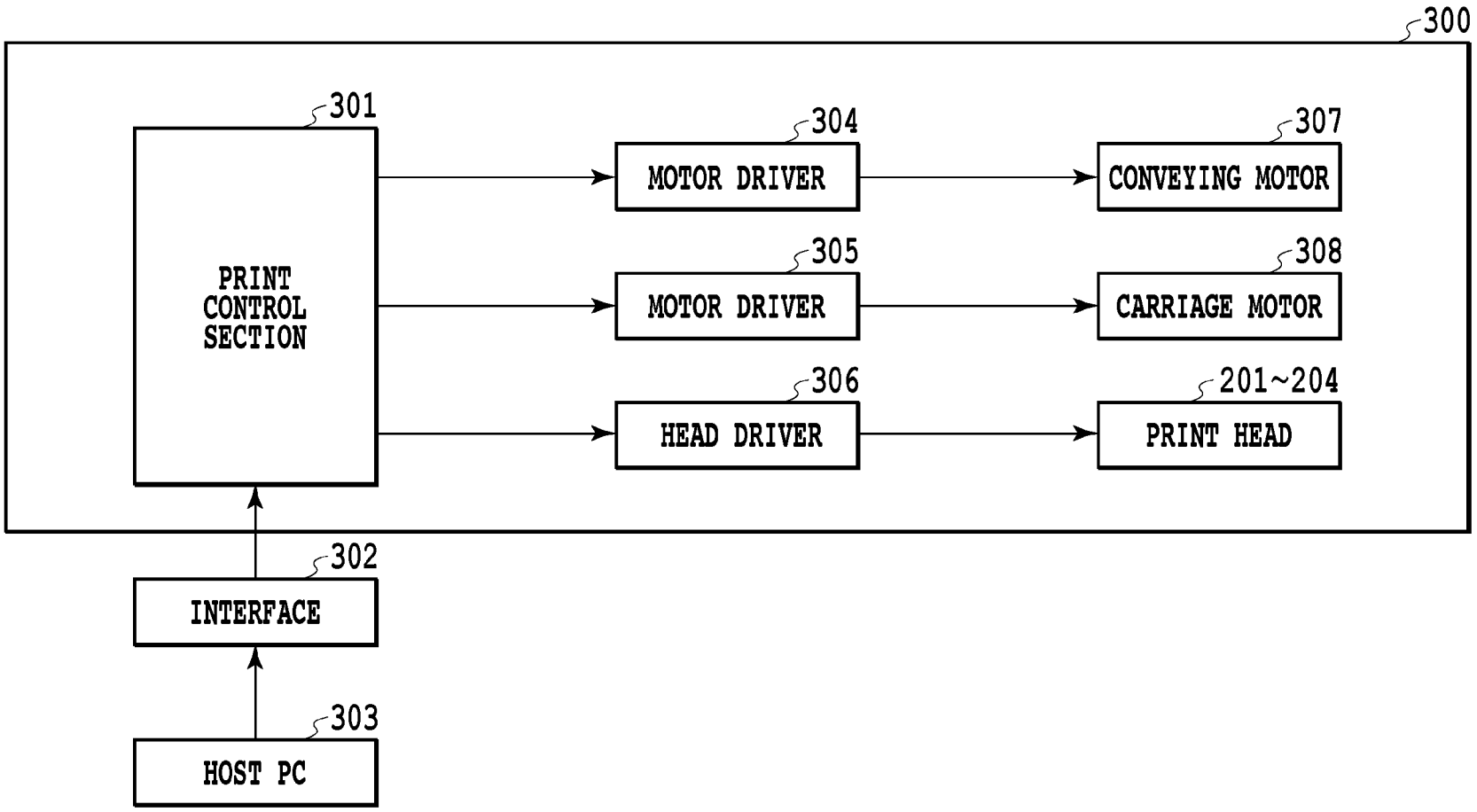
FIG. 2 is a block diagram showing a general configuration of a print control circuit in a printing apparatus according to the first embodiment.

FIG. 2 is a block diagram showing a general configuration of a print control circuit in the ink jet printing apparatus shown in FIG. 1A. An ink jet printing apparatus 300 is connected to a data supply device such as a host computer (hereinafter referred to as a host PC) via an interface 302. Various data transmitted by the data supply device, control signals for printing, and the like are input to a print control section 301 of the ink jet printing apparatus 300. The print control section 301 controls motor drivers 304 and 305 and head drivers 306, all of which will be described below, in accordance with control signals input via the interface 302. Furthermore, the print control section 301 processes input image data. A conveying motor 307 is configured to rotate the conveying rollers 209 and 210 to convey a print medium 218. A carriage motor 308 is configured to move the carriage 213 with the print heads 201 to 204 mounted thereon, in a reciprocating manner. The motor drivers 304 and 305 are configured to drive the conveying motor 307 and the carriage motor 308, respectively. The head drivers 306 are configured to drive the print heads 201 to 204; the head drivers 306 are equal to the print heads in number.

Now, the printing method according to the present embodiment will be described. In the present embodiment, the print medium is moved such that the relative amount of movement of the print medium following the forward scan differs from that following the rearward scan. The print duty for the first scan is set higher than that for the second scan so that the above-described conveying operation allows the colors to be constantly printed in the same order for each band, thus reducing possible time difference unevenness.

Figure 3A:
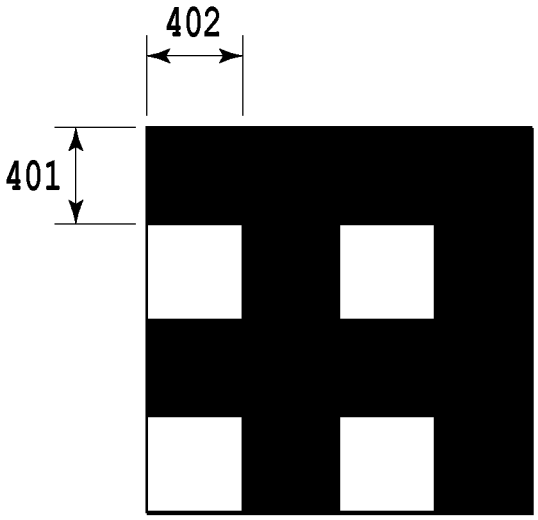
FIGS. 3A and 3B are diagrams showing a thinning out mask for use in a printing method according to the first embodiment.
Figure 3B:
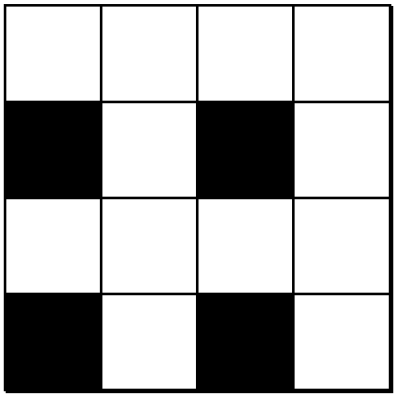

FIGS. 3A and 3B show a thinning out mask for use in a printing method according to the present embodiment. Filled-in portions denote pixels in which data is printed. Furthermore, the dimensions 401 and 402 of each pixel are the same as a nozzle pitch 105.

The present embodiment relates 2-pass printing in which one band of an image is formed by two scans. A mask shown in FIG. 3A is used to generate data to be printed during the first scan. A mask shown in FIG. 3B is used to generate data to be printed during the second scan.

In the present embodiment, when the mask shown in FIG. 3A and the mask shown in FIG. 3B are used to thin out print data, the amount of the data to be printed during the first scan is three times larger than that of the data to be printed during the second scan.

Figure 4:
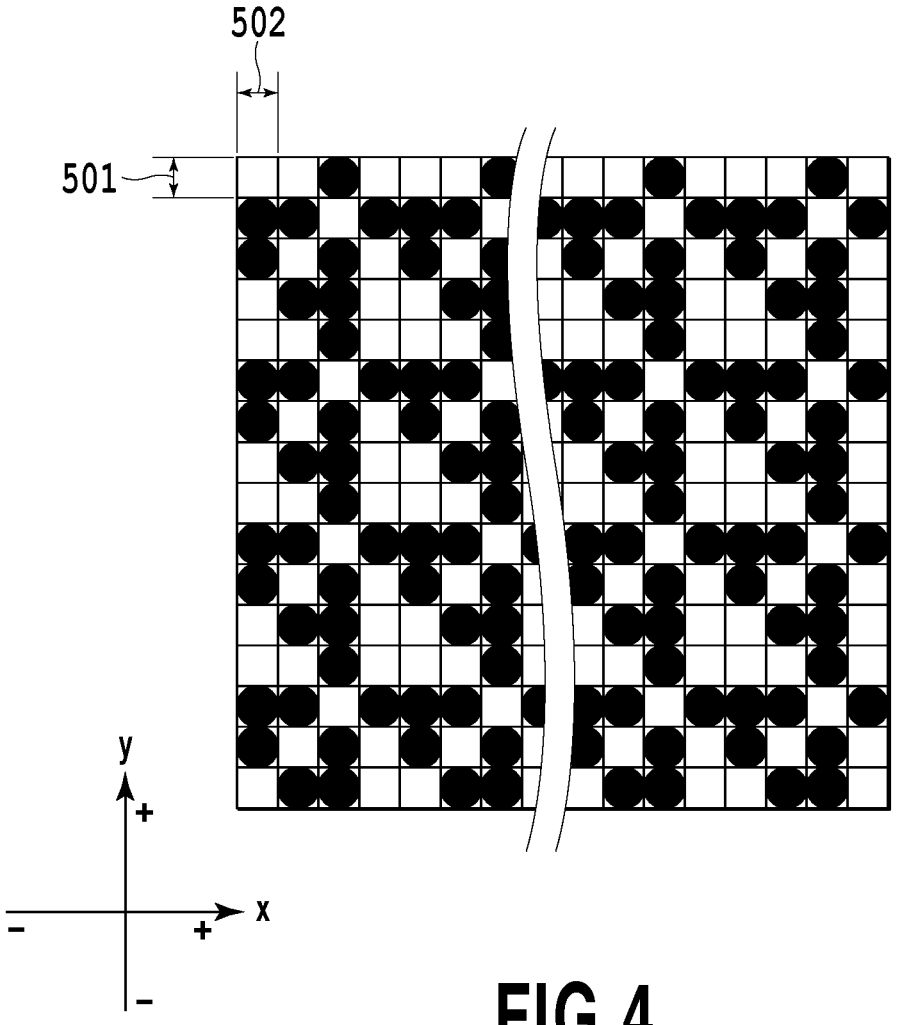
FIG. 4 is a diagram showing an example of image data according to the first embodiment.

FIG. 4 is a diagram showing an example of image data. Lengths 501 and 502 are each the same as the nozzle pitch 105. Each square represents one pixel. Sixteen pixels are arranged in a print medium conveying direction y. The number of pixels in a carriage scan direction x corresponds to a width of 24 inches. Filled-in circles in FIG. 4 represent print data. This image is assumed to be printed in cyan and yellow.

FIGS. 5A to E are diagrams illustrating a printing operation according to the present embodiment.

Figure 5A:
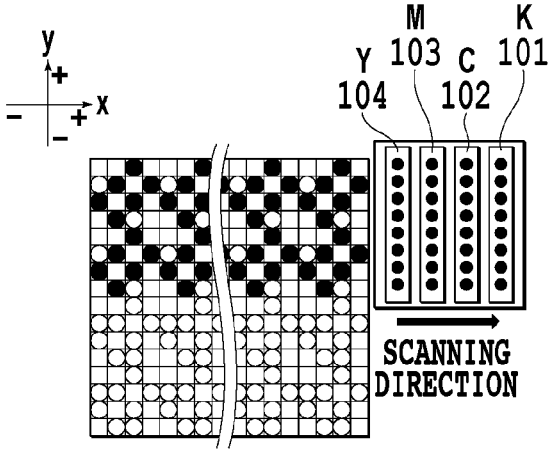
FIGS. 5A to 5E are diagrams illustrating a printing operation according to the first embodiment.

First, the print heads are moved for scanning in an X and +direction. Print data is obtained by using the thinning out mask shown in FIG. 3A to thin out the print data shown in FIG. 4. FIG. 5A shows the print data and the position of the print heads after the end of the first scan. In FIG. 5A, filled-in circles denote dots printed by the first scan.

The thinning out mask is intended for 4 pixels×4 pixels. For more pixels, the same pattern is repeatedly used.

Here, first, cyan data is printed at a duty of 37.5%, and then yellow data is printed at a duty of 37.5%. That is, an image is printed at a total duty of 75%.

Figure 5B:
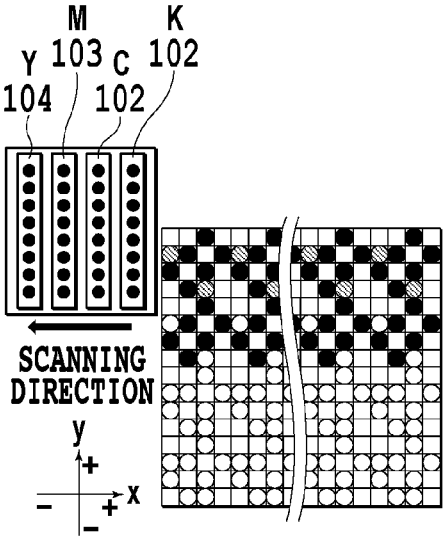

Then, the print medium is conveyed in a Y AND −direction by a distance corresponding to four nozzles. The print head is moved for scanning in an X AND −direction. Data is printed which is obtained by using the thinning out mask shown in FIG. 3B to thin out the print data shown in FIG. 4. FIG. 5B shows the print data and the position of the print heads after the end of the second scan. In FIG. 5B, shaded circles represent dots printed by the second scan.

Here, first, yellow data is printed at a duty of 12.5%, and then cyan data is printed at a duty of 12.5%. That is, an image is printed at a total duty of 25%.

Figure 5C:
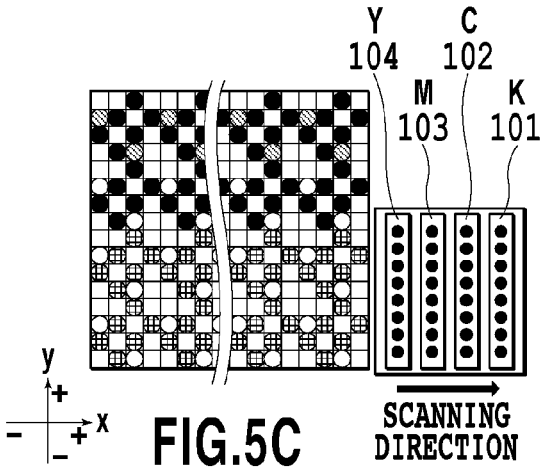

Then, the print medium is conveyed in Y and +direction by a distance corresponding to 12 nozzles. The print head is moved for scanning in the X and +direction. Data is printed which is obtained by using the thinning out mask shown in FIG. 3A to thin out the print data shown in FIG. 4. FIG. 5C shows the print data and the position of the print heads after the end of the third scan. In FIG. 5C, checkered circles represent dots printed by the third scan.

Here, first, cyan data is printed at a duty of 37.5%, and then yellow data is printed at a duty of 37.5%. That is, an image is printed at a total duty of 75%.

Figure 5D:
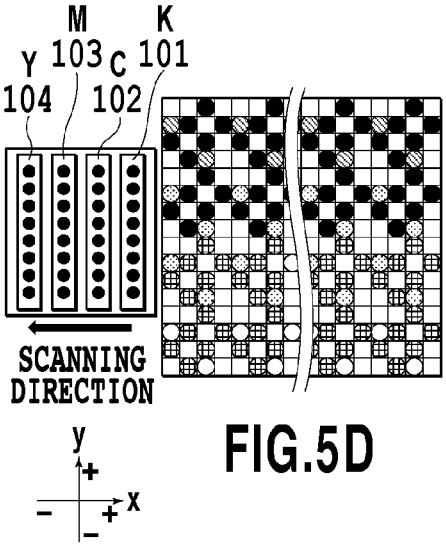

Then, the print medium is conveyed in the Y and −direction by a distance corresponding to four nozzles. The print head is moved for scanning in the X and −direction. Data is printed which is obtained by using the thinning out mask shown in FIG. 3B to thin out the print data shown in FIG. 4. FIG. 5D shows the print data and the position of the print heads after the end of the fourth scan. In FIG. 5D, dot-patterned circles represent dots printed by the fourth scan.

Here, first, yellow data is printed at a duty of 12.5%, and then cyan data is printed at a duty of 12.5%. That is, an image is printed at a total duty of 25%.

Then, since the print data according to the present embodiment includes 16 pixels in the Y direction, the fifth scan does not involve the conveyance or printing of the print medium. That is, the print heads only scan the print medium printed by the fourth scan, without printing the print medium.

Figure 5E:
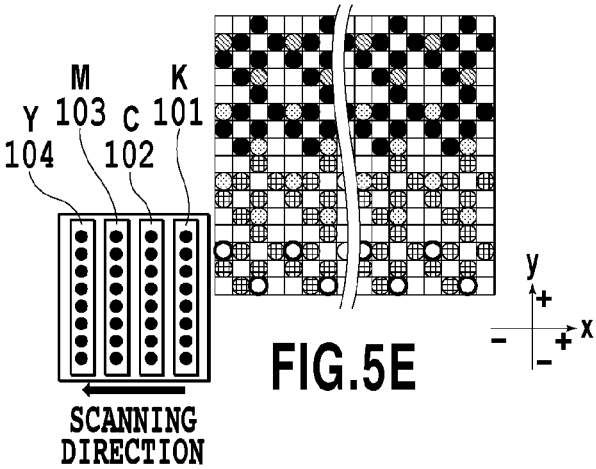

Then, the print medium is conveyed in the Y AND −direction by a distance corresponding to eight nozzles. The print head is moved for scanning in the X AND −direction. Data is printed which is obtained by using the thinning out mask shown in FIG. 3B to thin out the print data shown in FIG. 4. FIG. 5E shows the print data and the position of the print heads after the end of the sixth scan. In FIG. 5E, bold circles represent dots printed by the sixth scan.

Here, first, cyan data is printed at a duty of 37.5%, and then yellow data is printed at a duty of 37.5%. That is, an image is printed at a total duty of 75%.

The above-described operation allows the image data shown in FIG. 4 to be printed.

The print data according to the present embodiment includes 16 pixels in the Y direction. However, if the print data includes at least 17 pixels in the Y direction, the printing operation is further continued. In this case, when the fourth scan ends, the print medium is conveyed in the Y and +direction by a distance corresponding to 12 nozzles. The print head is then moved for scanning in the X and +direction. Data is printed which is obtained by using the thinning out mask shown in FIG. 3A to thin out the print data.

Figure 6:
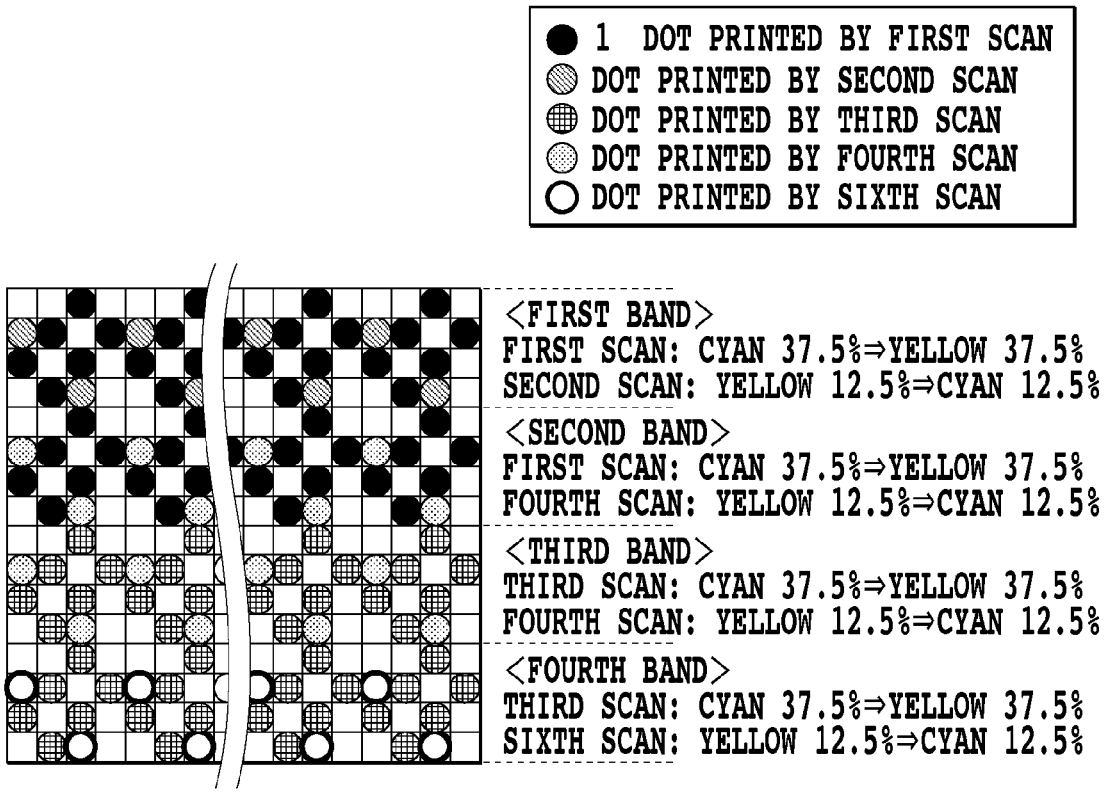
FIG. 6 is a diagram showing print dots in an image after the end of printing, the order of printing colors, and print duties.

FIG. 6 is a diagram showing the print dots in the image after the end of printing, the order of printing colors, and print duties. The order of printing colors and the print duties are the same for all the bands. However, the scan time for complementary scans varies among the bands. For example, for the first band, printing is finished by the first scan and the second scan. For the second band, printing is finished by the first scan and the fourth scan. Thus, the duration from the end of a scan starting printing until the beginning of a scan completing the printing varies among the bands.

The mechanism of a difference in coloring among the bands resulting from a difference in time among the scans will be described.

Figure 7A:
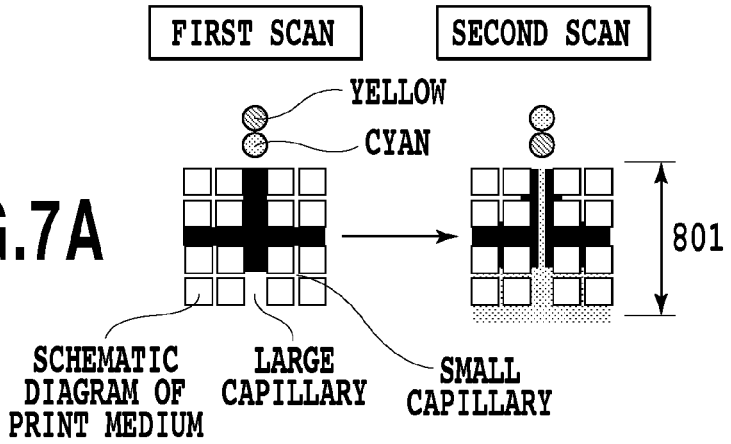
FIGS. 7A to 7D are schematic diagrams showing a modeled print sheet.
Figure 7B:
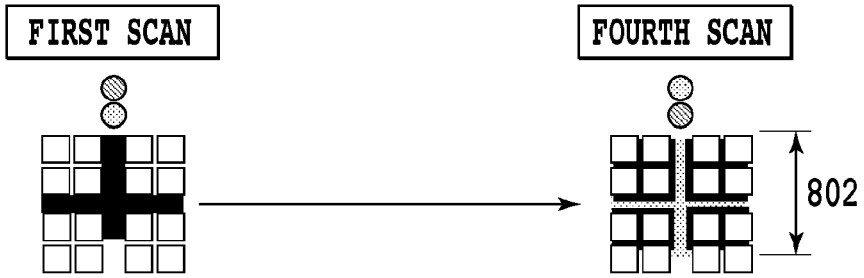

FIGS. 7A to 7D is a schematic diagram of a modeled print sheet showing a large capillary and a small capillary in the sheet. First, FIGS. 7A and 7B are schematic diagrams showing that the same print duties are used for each scan. FIG. 7A is a schematic diagram showing that the second scan is carried out after the first scan without any print time between the first and second scans. FIG. 7B is a schematic diagram showing that the second scan is carried out a certain print time after the first scan.

In FIG. 7A, during the first scan, when cyan ink droplets and then yellow ink droplets impact the print sheet, the inks are absorbed through the large capillary. Then, the second scan is carried out without any print time between the first and second scans, and during the second scan, yellow ink droplets and then cyan ink droplets impact the print sheet. Then, the inks printed by the second scan push aside the inks printed by the first scan and permeate to the inside of the print sheet, where the inks are fixed. The permeant depth at this time is denoted by 801.

In FIG. 7B, during the first scan, when cyan ink droplets and then yellow ink droplets impact the print sheet, the inks are absorbed through the large capillary. Then, after a sufficient print time difference, the second scan is carried, and yellow ink droplets and then cyan ink droplets impact the print sheet. Then, the inks printed by the first scan reach the small capillary and absorbed. Thus, the inks printed by the second scan infiltrate to the large capillary in a front layer of the print sheet, where the inks are fixed. The permeant depth at this time is denoted by 802.

The difference between the permeant depths 801 and 802, shown in FIGS. 7A and 7B, leads to a difference in coloring, resulting in print unevenness caused by the inter-scan print time difference between the first and second bands.

Figure 7C:
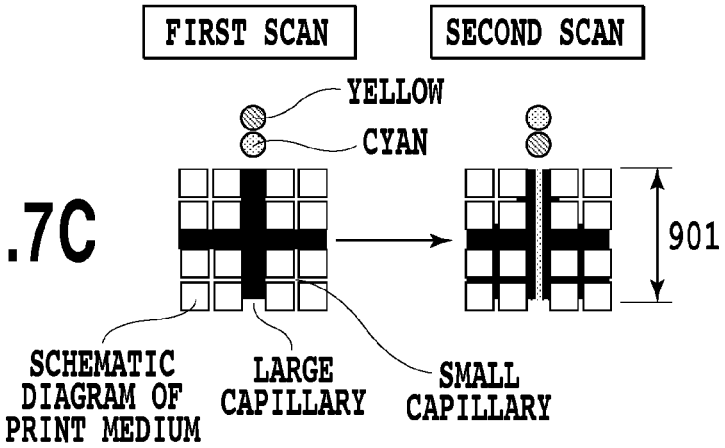
Figure 7D:
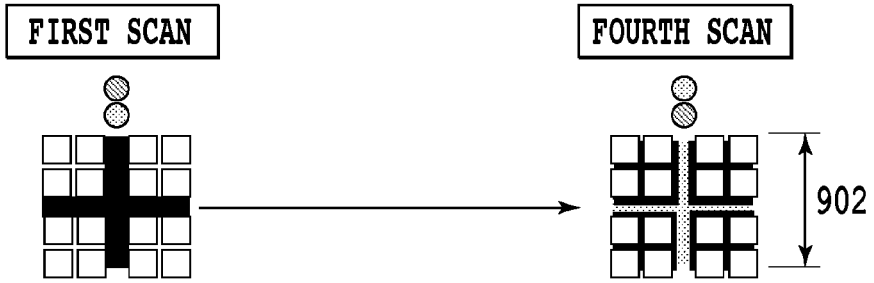

Now, the case where the first scan involves a higher duty than the second scan will be described. FIGS. 7C and 7D are schematic diagrams showing that the first scan involves a higher duty than the second scan. In FIG. 7C, during the first scan, when cyan ink droplets and then yellow ink droplets impact the print sheet, the inks are absorbed through the large capillary. Then, the second scan is carried after the first scan without any difference in the print time between the first and second scans, and yellow ink droplets and then cyan ink droplets impact the print sheet. Then, the inks push aside the inks printed by the first scan and infiltrate to the inside of the print sheet, where the inks are fixed. The permeant depth at this time is denoted by 901.

In this case, the amount of inks during the second scan is small, and thus the inks are fixed closer to the front layer of the print sheet than in FIG. 7A.

In FIG. 7D, during the first scan, when cyan ink droplets and then yellow ink droplets impact the print sheet, the inks are absorbed through the large capillary. Then, after a sufficient print time difference, the second scan is carried, and yellow ink droplets and then cyan ink droplets impact the print sheet. Then, the inks printed by the first scan reach the small capillary and absorbed. Thus, the inks printed by the second scan infiltrate to the large capillary in the front layer of the print sheet, where the inks are fixed. The permeant depth at this time is denoted by 902.

Here, the difference between the permeant depth 901 and 902 shown in FIGS. 7C and 7D is smaller than that between the permeant depth 801 and 802 shown in FIGS. 7A and 7B. That is, the difference in coloring is smaller when the duties for the first scan are set higher than those for the second scan than when printing is carried out at the same duties for each scan. This reduces unevenness resulting from the inter-scan time difference between the first band and the second band.

As described above, in the printing method according to present embodiment, the colors are printed in the same order for all the bands. The time difference unevenness can be reduced by setting the print duty for the preceding print scan higher than that for the succeeding print scan.

In the present embodiment, the mask pattern used is such that the print duty for the first scan is 75% and that the print duty for the first scan is 25.5%. However, the present invention is not limited to such a mask pattern. That is, the duty may be set so as to lead to such a state as shown in FIGS. 7C and 7D.

Furthermore, in the printing method according to the present embodiment, the print time from the end of the first scan until the beginning of the second scan varies among the bands each with a width equal to half of the width of the print head. However, the present invention is not limited to such a printing method. That is, the bands need not have the same width. The printing method may be such that a predetermined area is printed by two scans and that colors are printed in the same order for all the bands (areas).

Furthermore, in the present embodiment, the first scan direction is the forward scan direction, and the second scan direction is the backward scan direction. However, the present invention is not limited to these directions. That is, if the first scan is carried out in one of the forward and backward directions, the second scan is executed in the other direction.

(Second Embodiment)

In the first embodiment, the colors are printed in the same order for all the areas, and in the areas printed by reciprocating scans, the duty for the first scan is set higher than that for the second scan. In the present embodiment, the duty is selected for each print medium.

That is, according to the present invention, the first and second scans are differently set in order to reduce color unevenness based on the characteristics of permeant of inks through a print medium. Thus, the present embodiment varies the print duties for the first and second scans among print media with different permeant behaviors.

Figure 8A:
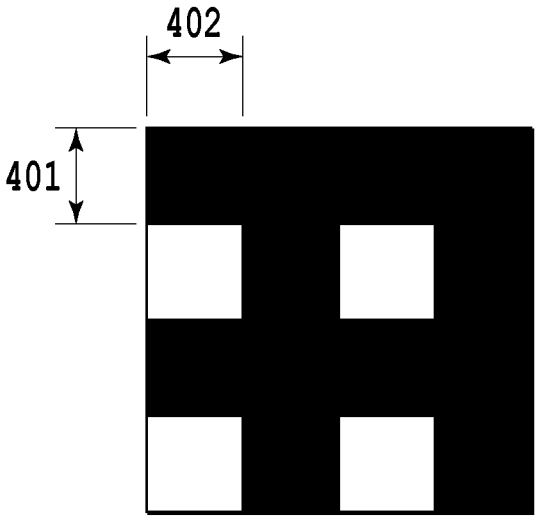
FIGS. 8A to 8D are diagrams showing thinning out masks for use in a printing method according to a second embodiment.
Figure 8B:
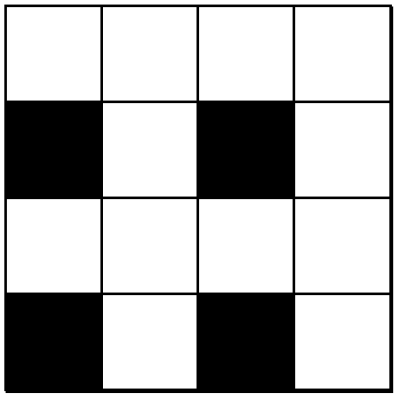
Figure 8C:
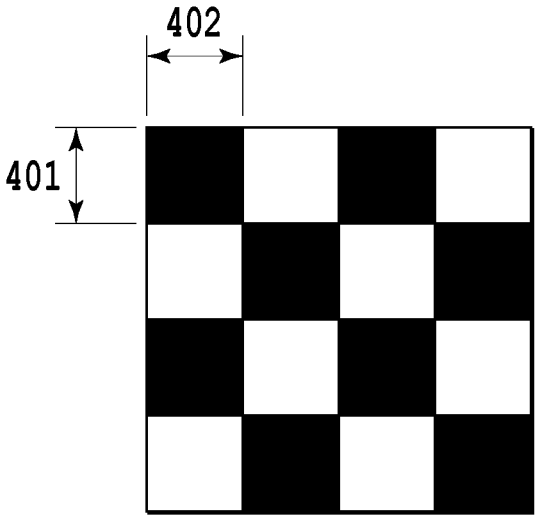
Figure 8D:
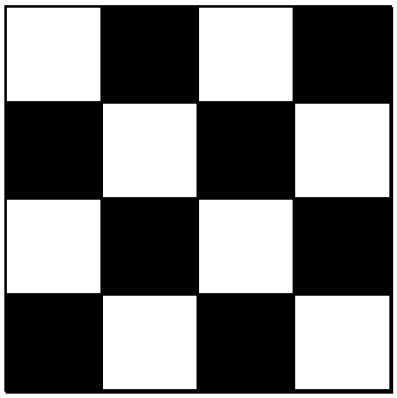

FIGS. 8A to 8D show thinning out masks for use in the printing method according to the present embodiment. Filled-in portions represent pixels in which the data is printed. The mask shown in FIG. 8A has a print duty of 75%. The mask shown in FIG. 8B has a print duty of 25%. The masks shown in FIG. 8C and FIG. 8D are thinning out masks with a print duty of 50%. The masks shown in FIG. 8A and FIG. 8B are in a complementary relationship. The masks shown in FIG. 8C and FIG. 8D are in a complementary relationship.

Figure 9:
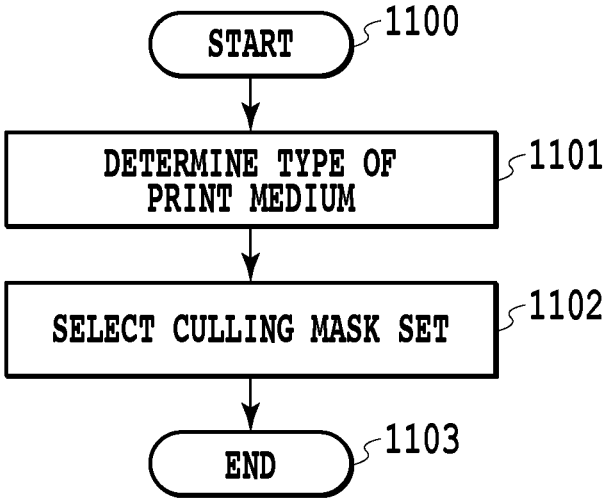
FIG. 9 is a flowchart showing a procedure for selecting a mask according to the second embodiment.

FIG. 9 is a flowchart showing a procedure for selecting a mask according to the present embodiment. When the host PC gives an instruction to start a printing operation, printing is started (step 1100). Then, the type of a print sheet set in the printing apparatus is determined (step 1101). Based on the type of the print sheet, a thinning out mask is selected (step 1102). The present embodiment allows either the set of the masks shown in FIGS. 8A and 8B or the set of the masks shown in FIGS. 8C and 8D to be selected.

A print sheet with a high permeant rate is unlikely to be affected by the time difference. Then, the set of the masks shown in FIGS. 8C and 8D is selected. On the other hand, a print sheet with a low permeant rate is likely to be affected by the time difference. Then, the set of the masks shown in FIGS. 8A and 8B is selected.

Now, an example of print data, print dots in an image after the end of printing, the order of printing colors, and print duties according to the present embodiment will be discussed.

Figure 10:
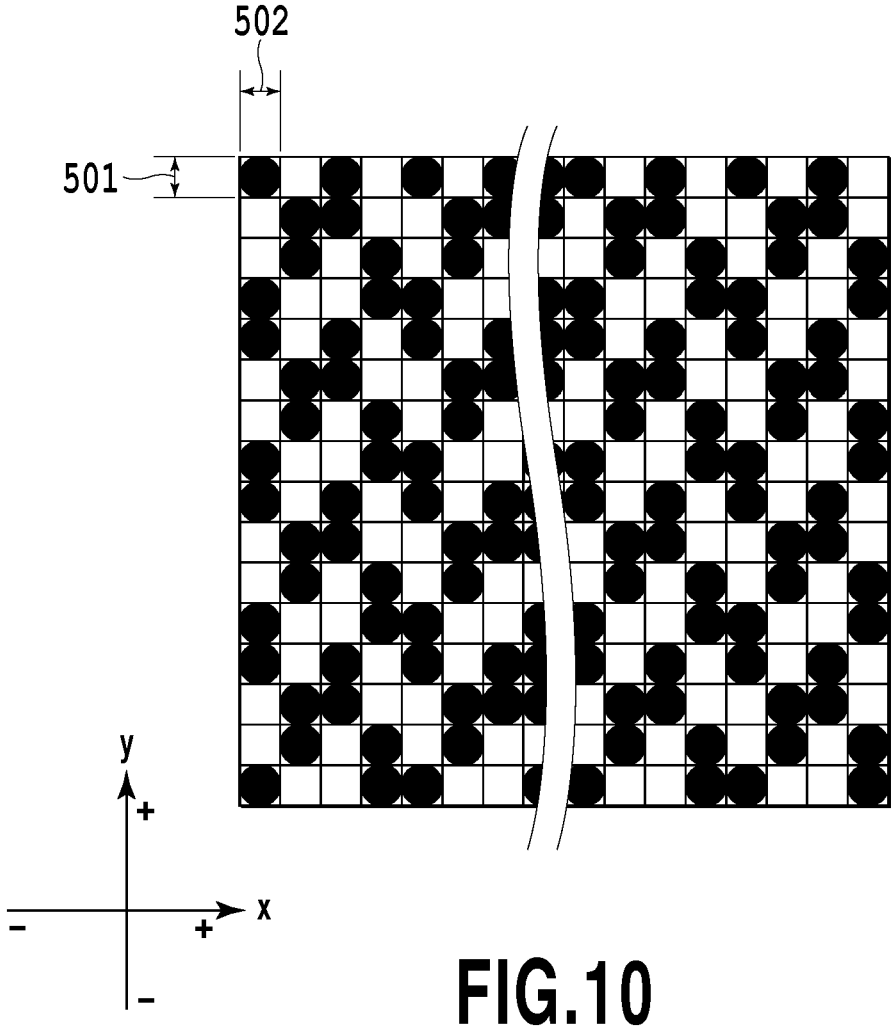
FIG. 10 is a diagram showing an example of image data according to the second embodiment.

FIG. 10 is a diagram showing an example of image data according to the present embodiment. Lengths 501 and 502 shown in FIG. 10 are the same as the nozzle pitch 105. Each square represents one pixel. Sixteen pixels are arranged in the print medium conveying direction y. The number of pixels in the carriage scan direction x corresponds to a width of 24 inches. Filled-in circles in FIG. 10 represent print data. This image is assumed to be printed in cyan and yellow.

Figure 11A:
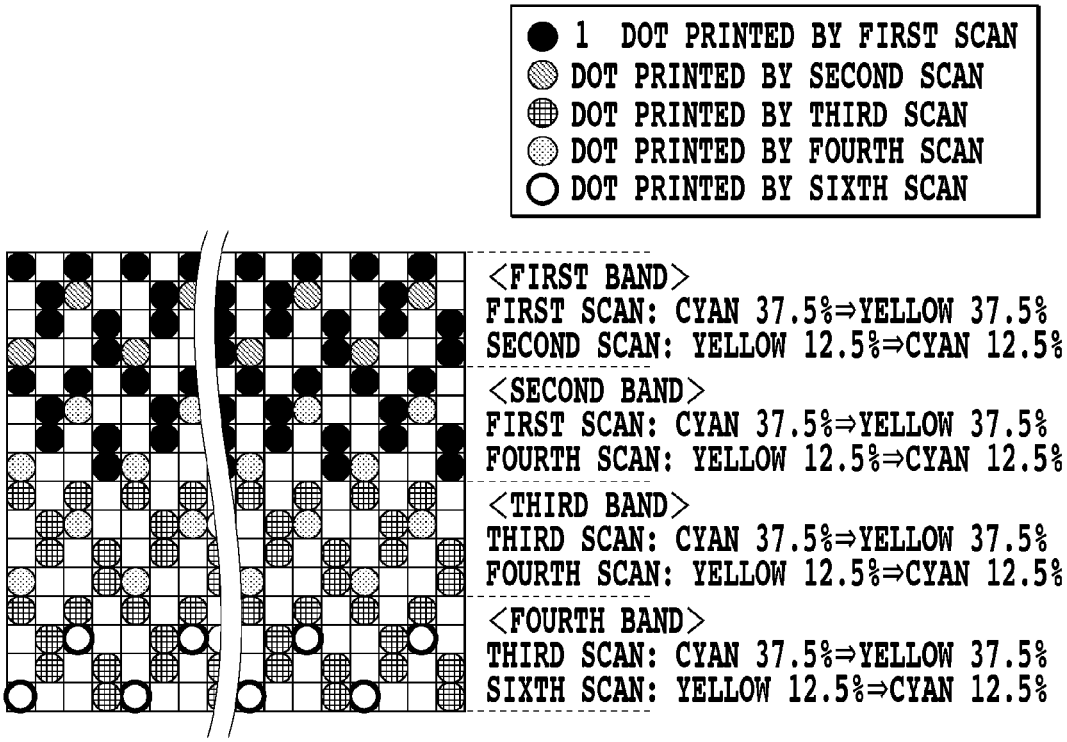
FIG. 11A and FIG. 11B are diagrams showing print dots in an image after the end of printing, the order of printing colors, and print duties.

FIG. 11A shows the results of printing carried out in accordance with a printing method similar to that in Embodiment 1, using the thinning out masks shown in FIGS. 8A and 8B. As shown in the printing results in FIG. 11A, the duration from the end of the first scan until the beginning of the second scan varies among the bands, and the print duty for the first scan is higher than that for the second scan. Such printing allows the time difference unevenness among the bands to be reduced for print media with low permeant rates as described in the first embodiment with reference to FIGS. 7A to D.

Figure 11B:
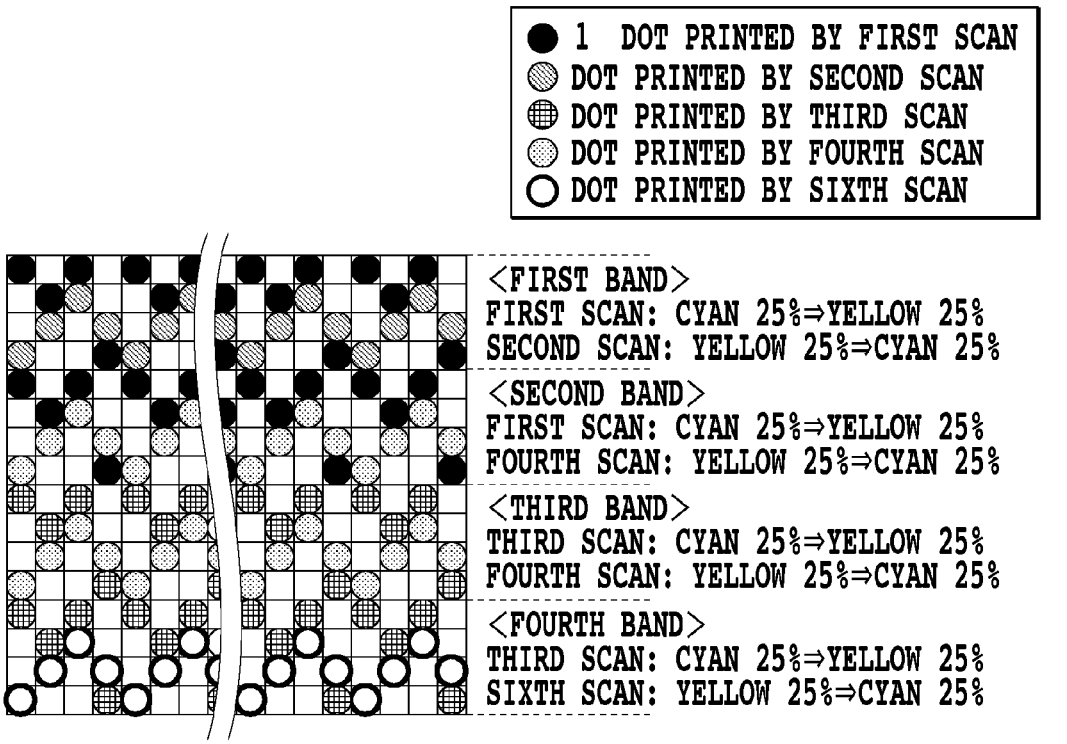

FIG. 11B shows the results of printing carried out in accordance with a printing method similar to that in Embodiment 1, using the thinning out masks shown in FIGS. 8C and 8D. As shown in the printing results in FIG. 11B, the duration from the end of the first scan until the beginning of the second scan varies among the bands as is the case with the printing results shown in FIG. 11A. However, the print duties for the first and second scans are equal and 50%. Thus, for print media with somewhat high permeant rates, even with an equal duty, print unevenness resulting from the print scan time difference is small and unnoticeable.

As described above, the present embodiment determines whether or not to set different duties for the first and second scans based on the ink permeant rate of the print medium, thus reducing band unevenness.

The present embodiment uses the two sets of masks for selection. However, at least three sets of mask patterns may be used. Furthermore, the duties of the mask patterns may be such that the conditions shown in FIGS. 7C and 7D can be established for each of the print media with different permeant rates.

(Third Embodiment)

As described above in the first and second embodiments, in the printing method according to the present invention, the colors are printed in the same order for all the bands, and the duty for the first scan is set higher than that for the second scan to reduce the time difference unevenness. The unevenness caused by the time difference varies depending on the size of the print medium in the scanning direction. That is, the difference, among the bands, in the duration from the end of the first scan until the beginning of the second scan is larger for print media with larger lengths in the scanning direction than for print media with smaller lengths in the scanning direction.

Thus, the present embodiment varies the duties for the first and second scans depending on the print medium size in the scanning direction.

The present embodiment uses the set of the masks shown in FIGS. 8A and 8B and the set of the masks shown in FIGS. 8C and 8D; both sets are used in the second embodiment.

Figure 12:
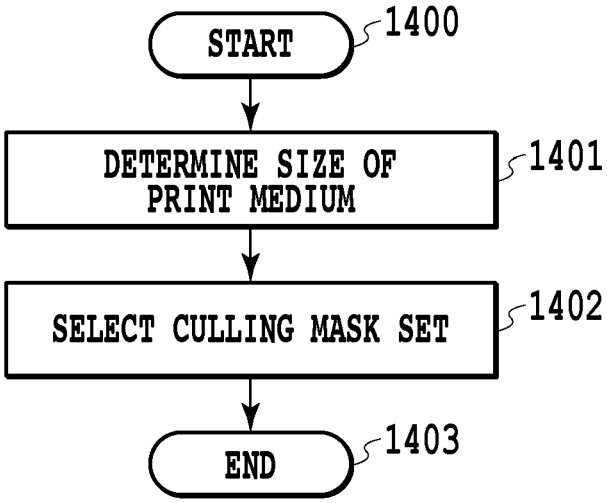
FIG. 12 is a flowchart showing a procedure for selecting a mask according to a third embodiment.

FIG. 12 is a flowchart showing a procedure for selecting a mask according to the present embodiment. When the host PC gives an instruction to start a printing operation, printing is started (step 1400). Then, the size, in the scanning direction (lateral size), of a print medium set in the printing apparatus is determined (step 1401). Based on the lateral size of the print medium, the set of the thinning out masks is selected (step 1402). That is, the present embodiment selects either the set of the masks shown in FIGS. 8A and 8B or the set of the masks shown in FIGS. 8C and 8D.

For print media with a smaller difference, among the bands, in the duration from the end of the first scan and the beginning of the second scan, the set of the masks shown in FIGS. 8C and 8D is selected. For print media with a larger difference, among the bands, in the duration from the end of the first scan and the beginning of the second scan, the set of the masks shown in FIGS. 8A and 8B is selected.

As described above, the time difference unevenness can be further reduced for each lateral print medium size by varying the ratio of the print duty for the first scan to the print duty for the second scan.

The present embodiment uses the two sets of masks for selection. However, at least three sets of mask patterns may be used. Furthermore, the duties of the mask patterns may be such that the conditions shown in FIGS. 7C and 7D can be established for each of the print media with different lateral sizes.

(Fourth Embodiment)

The printing method according to the present invention prints the colors in the same order for all the bands, and reduces the print unevenness caused by the time difference among the bands. In the preset embodiment further varies the print duty of the mask pattern set if the bands involve not only the difference in the duration from the end of the first scan and the beginning of the second scan but also a difference in image width.

The present embodiment uses the set of the masks shown in FIGS. 8A and 8B and the set of the masks shown in FIGS. 8C and 8D; both sets are used in the second embodiment.

Figure 13:
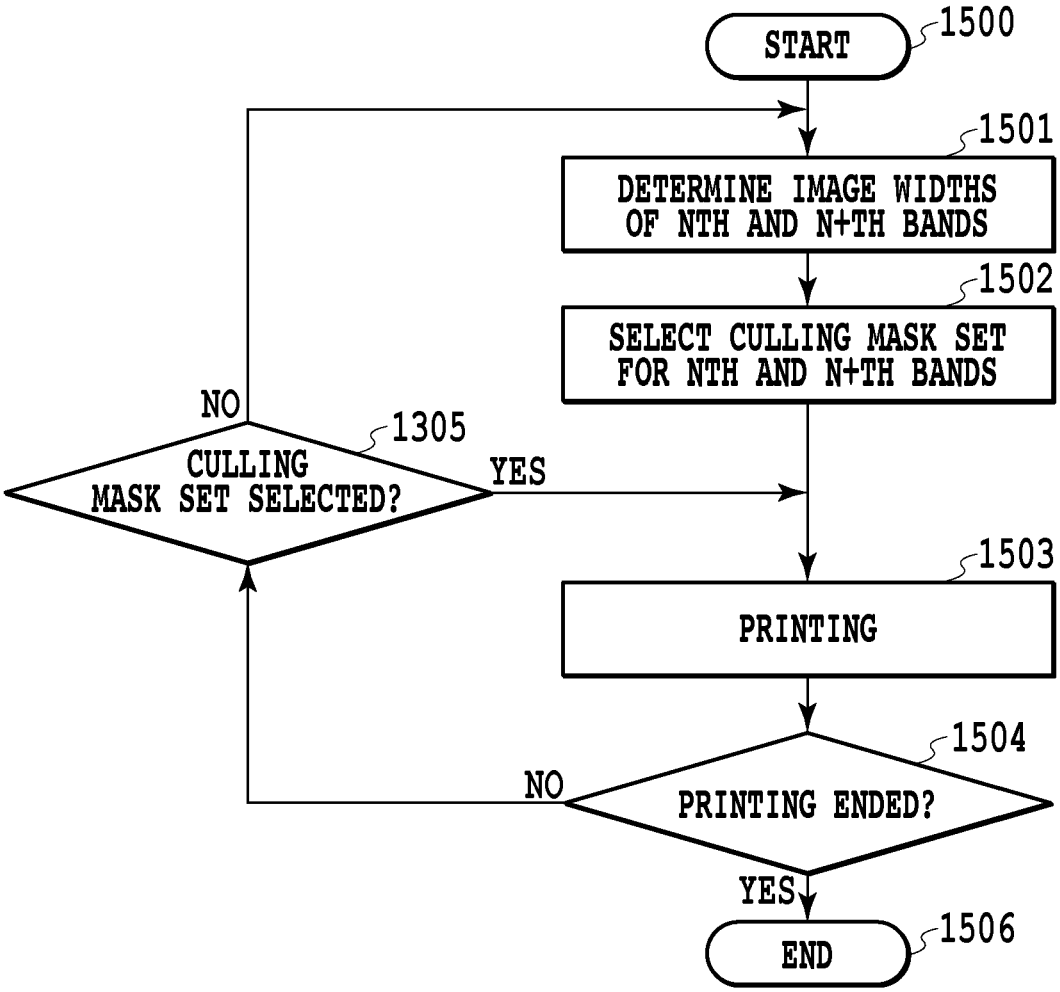
FIG. 13 is a flowchart showing a procedure for selecting a mask according to a fourth embodiment.

FIG. 13 is a flowchart showing a procedure for selecting a mask according to the present embodiment. When the host PC gives an instruction to start a printing operation, printing is started (step 1500). Then, the image width sizes of the Nth and (N+1)th bands are determined (step 1501). Based on the image width sizes, the mask set to be applied to the Nth and (N+1)th bands is selected (step 1502). That is, the present embodiment selects either the set of the masks shown in FIGS. 8A and 8B and the set of the masks shown in FIGS. 8C and 8D. Subsequently, the Nth and (N+1)th bands are printed using the selected masks (step 1503). The procedure then determines whether the printing has ended (step 1504). If the printing has ended, the printing operation is completed (step 1506). If the printing has not ended, the procedure determines whether the thinning out mask for the next band for scanning has been set (step 1505). If the thinning out mask has been set, the printing operation is started (step 1503). If the thinning out mask has not been set, the image width size is determined (step 1501). The printing is then continued in accordance with a similar procedure.

Figure 14:
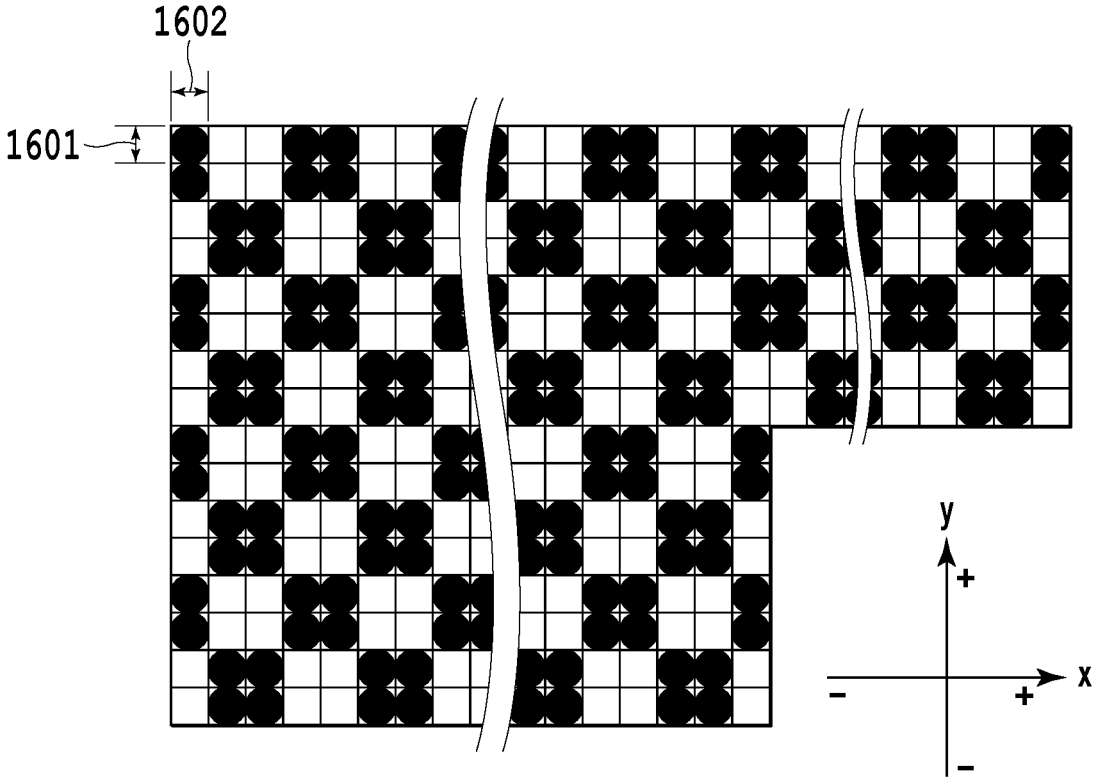
FIG. 14 is a diagram showing an example of image data according to the fourth embodiment.

FIG. 14 is a diagram showing an example of image data according to the present embodiment. Lengths 1601 and 1602 shown in FIG. 14 are the same as the nozzle pitch 105. Each square represents one pixel. Sixteen pixels are arranged in the print medium conveying direction y. In the carriage scan direction x, the number of pixels in the upper part of the image data corresponds to a width of 24 inches, and eight pixels in the lower part correspond to a width of 12 inches. Filled-in circles in FIG. 14 represent print data. This image is assumed to be printed in cyan and yellow.

The present embodiment also uses the set of the masks shown in FIGS. 8A and 8B and the set of the masks shown in FIGS. 8C and 8D; both sets are used in the second embodiment. The set of the masks shown in FIGS. 8A and 8B is assigned to the 16 pixels in the upper part with a longer duration from the end of the first scan and the beginning of the second scan. Furthermore, the set of the masks shown in FIGS. 8C and 8D is assigned to the 16 pixels in the upper part with a shorter duration from the end of the first scan and the beginning of the second scan.

Figure 15:
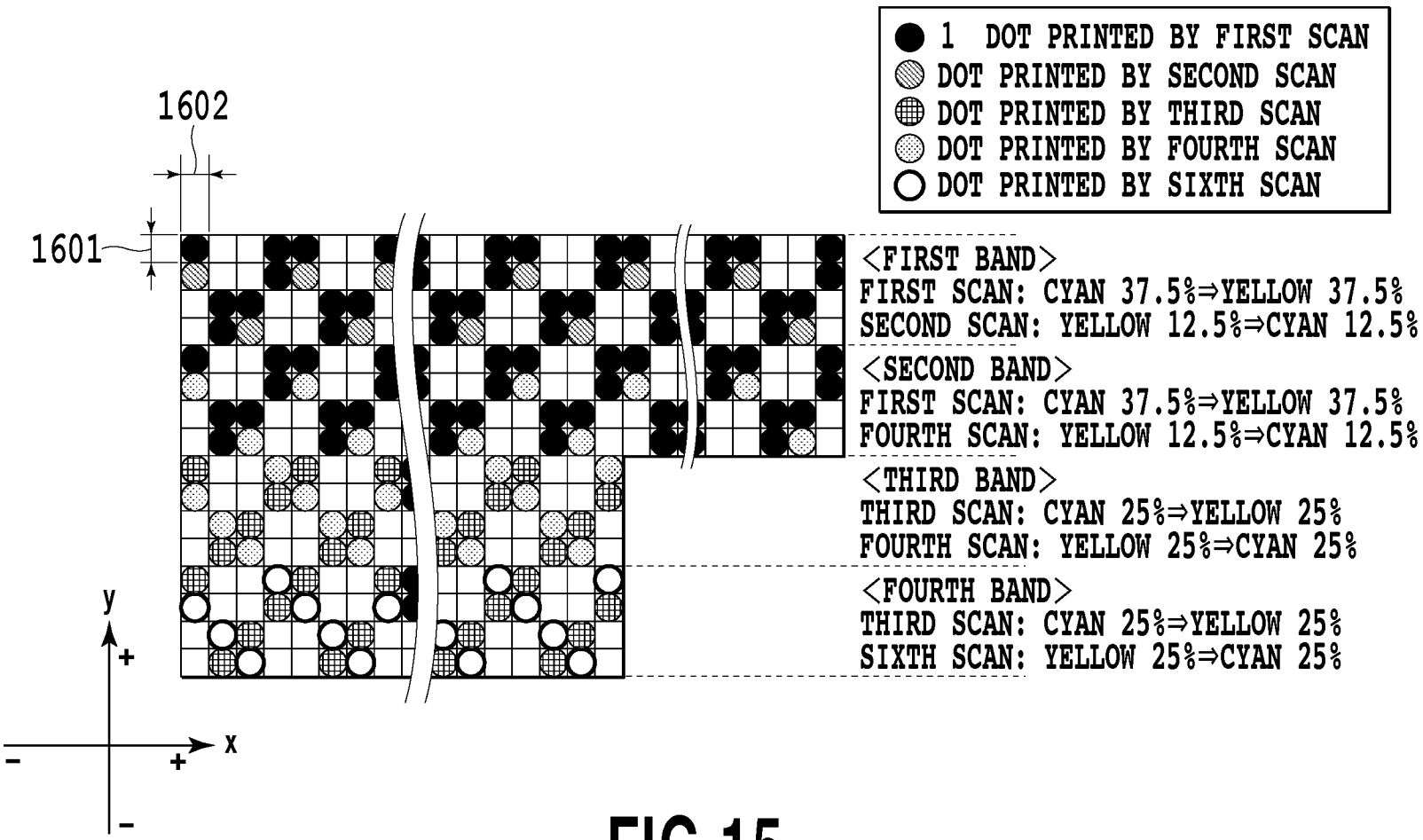
FIG. 15 is a diagram showing print dots in an image after end of printing, the order of printing colors, and print duties.

FIG. 15 is a diagram showing the print dots in the image after the end of printing, the order of printing colors, and print duties. Filled-in circles represent dots printed by the first scan. Shaded circles represent dots printed by the second scan. Filled-in circles represent dots printed by the first scan. Shaded circles represent dots printed by the second scan. Checkered circles represent dots printed by the third scan. Dot-like circles represent dots printed by the fourth scan. Bold circles represent dots printed by the sixth scan.

For the first and second bands, the duty of each of the cyan and yellow inks is 37.5% for the first scan and 12.5% for the second scan. On the other hand, for the third and fourth bands involving a smaller image width and a shorter duration from the end of the first scan until the beginning of the second scan than the first and second bands, the duty of each of the cyan and yellow inks is the same and 25% for both scans.

As described above, if one print data involves a mixture of different image widths, the time difference unevenness can further be reduced for each image width size by varying the ratio of the print duty for the first scan to the print duty for the second scan.

The present embodiment uses the two sets of masks for selection. However, at least three sets of mask patterns may be used. Furthermore, the duties of the mask patterns may be such that the conditions shown in FIGS. 7C and 7D can be established for each of several image widths.

(Fifth Embodiment)

In the first embodiment, the print duty for the first scan is set higher than that for the second scan in order to suppress the print unevenness caused by the time difference among the bands with different durations from the end of the first scan until the beginning of the second scan. In the present embodiment, the duties for the first and second scans are changed only if the duration from the end of the first scan until the beginning of the second scan is long, that is, if printing with the same duty results in such a phenomenon as described in FIG. 7A. Thus, the present embodiment uses the set of the masks shown in FIGS. 8A and 8B and the set of the masks shown in FIGS. 8D and 8C.

Figure 16:
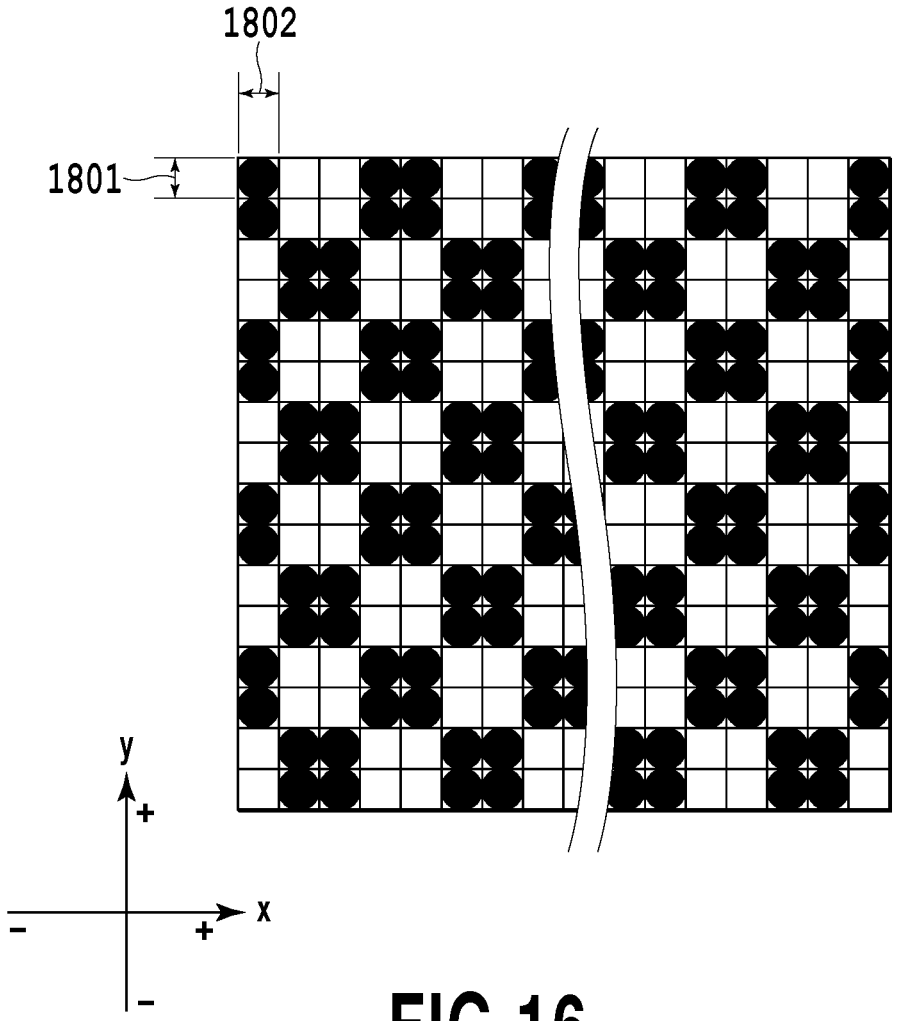
FIG. 16 is a diagram showing an example of image data according to a fifth embodiment.

FIG. 16 is a diagram showing an example of image data. Lengths 1801 and 1802 are the same as the nozzle pitch 105. Each square represents one pixel. Sixteen pixels are arranged in the print medium conveying direction y. The number of pixels in the carriage scan direction x corresponds to a width of 24 inches. Filled-in circles in FIG. 16 represent print data. This image is assumed to be printed in cyan and yellow.

Figure 17A:
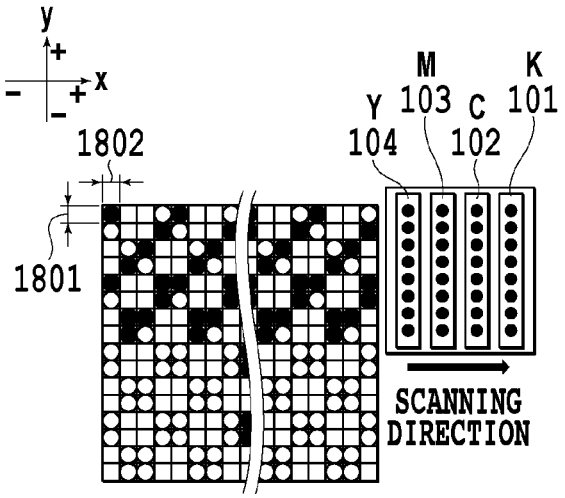
FIGS. 17A to 17E are diagrams illustrating a printing operation according to the fifth embodiment.

FIGS. 17A to 17 E are diagrams illustrating a printing operation according to the present embodiment.

First, The print heads are moved for scanning in the X AND +direction to print the data from which the print data shown in FIG. 16 is thinned out using the thinning out mask shown in FIG. 8C for the upper four nozzles and the thinning out mask shown in FIG. 8A for the lower four nozzles. FIG. 17A shows print data and the position of the print heads after the end of the first scan. In FIG. 17A, filled-in circles represent dots printed by the first scan.

Figure 17B:
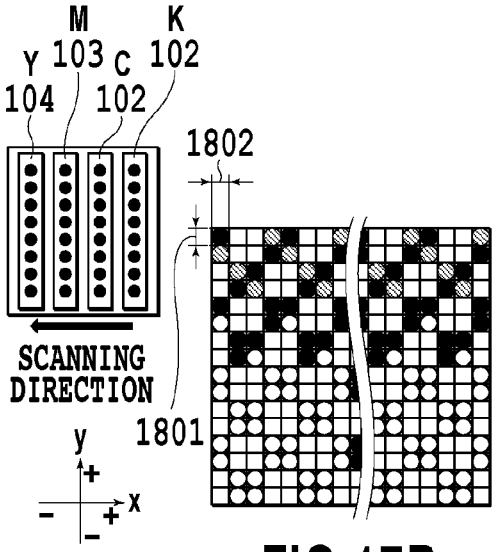

Then, the print medium is conveyed in the Y AND −direction by a distance corresponding to four nozzles. The print heads are moved for scanning in the X AND −direction to print the data from which the print data shown in FIG. 16 is thinned out using the thinning out mask shown in FIG. 8B for the upper four nozzles and the thinning out mask shown in FIG. 8D for the lower four nozzles. FIG. 17B shows print data and the position of the print heads after the end of the third scan. In FIG. 17B, shaded circles represent dots printed by the third scan.

Figure 17C:
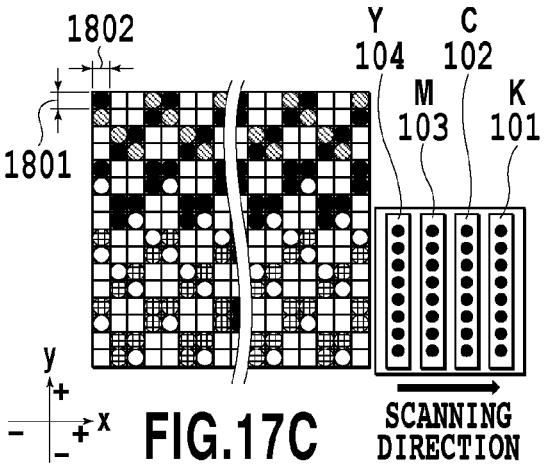

Then, the print medium is conveyed in the Y AND +direction by a distance corresponding to 12 nozzles. The print heads are moved for scanning in the X AND +direction to print the data from which the print data shown in FIG. 16 is thinned out using the thinning out mask shown in FIG. 8C for the upper four nozzles and the thinning out mask shown in FIG. 8A for the lower four nozzles. FIG. 17C shows print data and the position of the print heads after the end of the third scan. In FIG. 17C, checkered circles represent dots printed by the third scan.

Figure 17D:
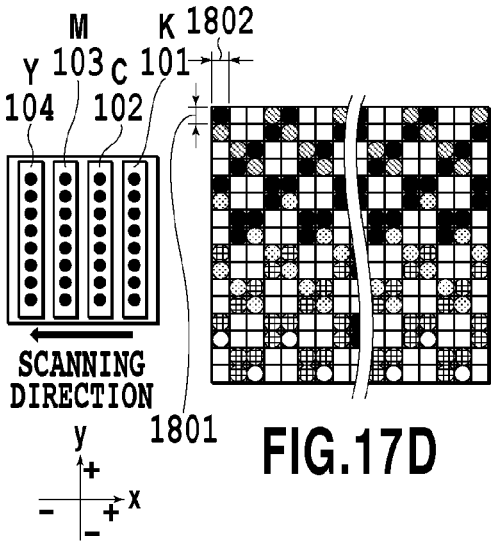

Then, the print medium is conveyed in the Y AND −direction by a distance corresponding to four nozzles. The print heads are moved for scanning in the X AND −direction to print the data from which the print data shown in FIG. 16 is thinned out using the thinning out mask shown in FIG. 8B for the upper four nozzles and the thinning out mask shown in FIG. 8D for the lower four nozzles. FIG. 17D shows print data after the end of the third scan and the position of the print heads. In FIG. 17D, dot-patterned circles represent dots printed by the third scan.

Then, since the print data according to the present embodiment includes 16 pixels in the Y direction, the fifth scan does not involve the conveyance or printing of the print medium. That is, the print heads only scan the print medium printed by the fourth scan, without printing the print medium.

Figure 17E:
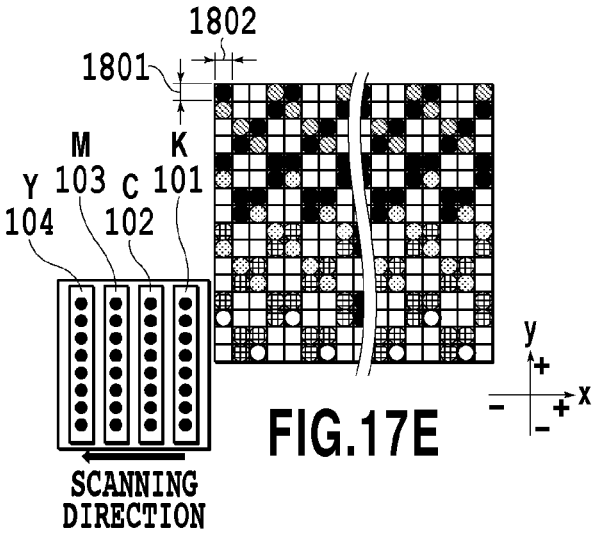

Finally, the print medium is conveyed in the Y AND −direction by a distance corresponding to eight nozzles. The print heads are moved for scanning in the X AND −direction to print the data from which the print data shown in FIG. 16 is thinned out using the thinning out mask shown in FIG. 8B. FIG. 17E shows print data and the position of the print heads after the end of the sixth scan. In FIG. 17E, bold circles represent dots printed by the sixth scan.

Figure 18:
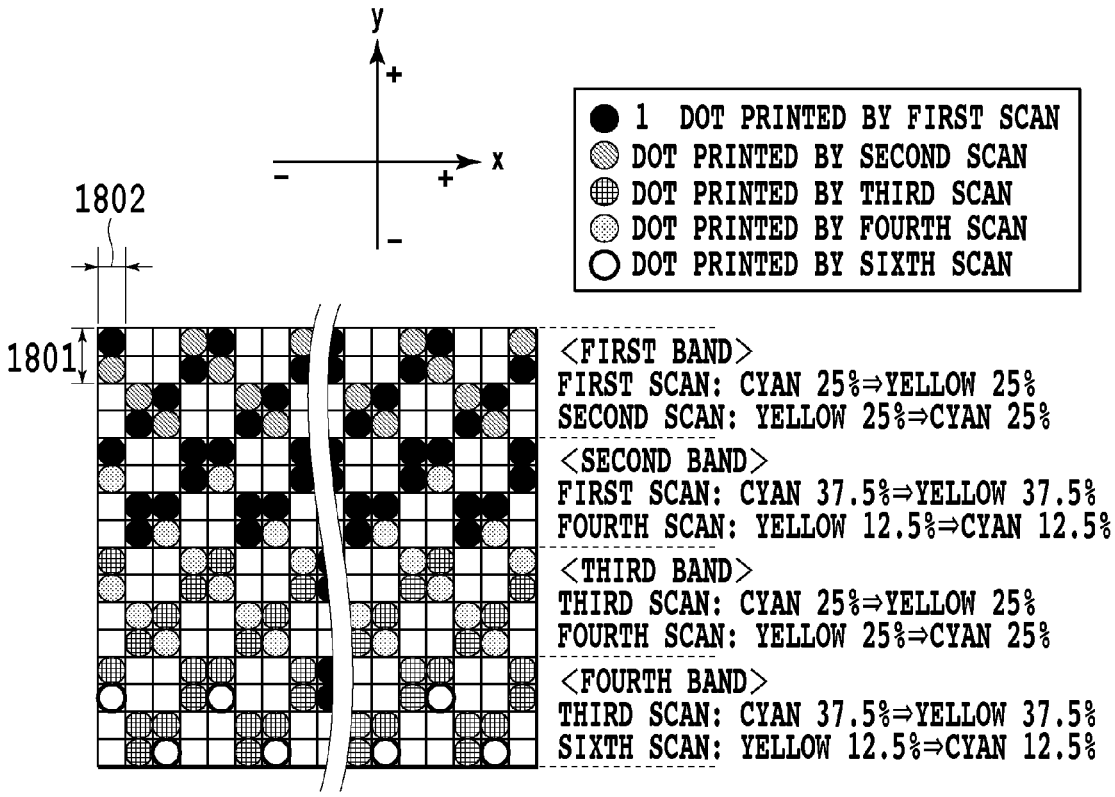
FIG. 18 is a diagram showing print dots in an image after end of printing, the order of printing colors, and print duties.

FIG. 18 shows the print dots in the image after the end of printing, the order of printing colors, and print duties. The order of printing colors and the print duty are the same for each band. The first and third bands with a shorter duration from the end of the first scan until the beginning of the second scan have the same duty for the first and second scans. On the other hand, the second and fourth bands with a longer duration from the end of the first scan until the beginning of the second scan have a higher duty for the first scan than for the second scan.

As described above, the depth over which the inks infiltrate through the print medium can be controlled for each band. As a result, band unevenness can be suppressed in which the duration from the end of the first scan until the beginning of the second scan varies among the bands.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-105242, filed May 10, 2011, which is hereby incorporated by reference herein in its entirety.

What is claimed is:

1. An ink jet printing apparatus comprising:

a print head including a nozzle array formed by a plurality of nozzles that are for ejecting ink and that are arranged in a predetermined direction for forming an image on a print medium;

a scanning unit configured to scan the print head in a forward direction and a backward direction crossing said predetermined direction;

a conveying unit for conveying the print medium forward and backward in the predetermined direction;

a generation unit configured to generate print data used for printing by the print head in such a manner that print duty of the print head for performing said scanning in the forward direction is higher than print duty of the print head for performing said scanning in the backward direction; and a control unit configured to control the print head, the scanning unit, and the conveying unit, wherein, after printing on one image area of the print medium by the print head scanned in the forward direction by the scanning unit, the control unit controls the conveying unit to convey the print medium forward for printing on another image area of the print medium adjacent to said one image area in the predetermined direction, and the control unit controls the print head and the scanning unit such that the print head being scanned in the forward direction by the scanning unit prints an image on the another image area, and wherein, after the print head prints the image on the another image area, the control unit controls the conveying unit to convey the print medium backward for printing on an area straddling said one image area and the another image area, and the control unit controls the print head and the scanning unit such that the print head being scanned in the backward direction by the scanning unit prints an image on said area straddling said one image area and the another image area.

2. The ink jet printing apparatus according to claim 1, wherein the print duties vary according to the print medium for printing.

3. The ink jet printing apparatus according to claim 1, wherein the print duties vary according to length of the print medium in a scanning direction.

4. The ink jet printing apparatus according to claim 1, wherein the print duties are obtained by separating image data by a mask pattern.

5. The ink jet printing apparatus according to claim 1, wherein said width in said predetermined direction of said image area is half of the total length of said nozzle array in said predetermined direction.

6. A method for forming an image area on a print medium in an inkjet printing apparatus comprising a print head including a nozzle array formed by a plurality of nozzles that are for ejecting ink and that are arranged in a predetermined direction, for forming an image on a print medium; a scanning unit configured to scan the print head in a forward direction and a backward direction crossing said predetermined direction; a conveying unit for conveying the print medium forward and backward in the predetermined direction, said method comprising the steps of:

generating print data used for printing by the print head in such a manner that print duty of the print head for performing said scanning in the forward direction is higher than print duty of the print head for performing said scanning in the backward direction; and controlling the print head, the scanning unit, and conveying unit, wherein after printing on one image area of the print medium by the print head scanned in the forward direction by the scanning unit, the conveying unit is controlled to convey the print medium forward for printing on another image area of the print medium adjacent to said one image area in the predetermined direction, and the print head and the scanning unit are controlled such that the print head being scanned in the forward direction by the scanning unit prints an image on the another image area, and wherein, after the print head prints the image on the another image area, the conveying unit is controlled to convey the print medium backward for printing on an area straddling said one image area and the another image area, and the print head and the scanning unit are controlled such that the print head being scanned in the backward direction by the scanning unit prints an image on said area straddling said one image area and the another image area.

7. The method according to claim 6, wherein the print duties vary according to the print medium for printing.

8. The method according to claim 6, wherein the print duties vary according to length of the print medium in a scanning direction.

9. The method according to claim 6, wherein the print duties are obtained by separating image data by a mask pattern.

10. The method according to claim 6, wherein said width in said predetermined direction of said image area is half of the total length of said nozzle array in said predetermined direction.

11. The ink jet printing apparatus according to claim 1, wherein the conveying unit conveys the print medium backward for printing a part of said one image area between the processes of printing on said one image area by the print head scanned in the forward direction by the scanning unit and conveying the print medium forward by the conveying unit for printing to the another image area.

12. The ink jet printing apparatus according to claim 1, wherein the length of each of the one image area and the another image area in the predetermined direction corresponds to the length of the nozzle array in the predetermined direction.

13. The ink jet printing apparatus according to claim 1, wherein a band area of the print medium with which length in the predetermined direction corresponding to the conveying amount by the conveying unit for conveying the print medium backward is printed by the scanning unit through two scans of the print head.

14. The ink jet printing apparatus according to claim 1, wherein the print head includes a plurality of nozzle arrays each configured to eject a plurality of different colors of inks, and the generation unit generates the print data in such a manner that print duty of the print head for performing said scanning in the forward direction is higher than print duty of the print head for performing said scanning in the backward direction.

15. The jet printing apparatus according to claim 1, wherein the generation unit generates print data in such a manner that print duty of the print head for performing said scanning in the forward direction is higher than print duty of the print head for performing said scanning in the backward direction, the print duties being set by a mask pattern for thinning out the image data printed on a print medium and the mask pattern being used in generating print data for printing in a first scan of the print head by the scanning unit.

16. The ink jet printing apparatus according to claim 1, wherein the print duties vary depending on the print medium for printing.

17. The ink jet printing apparatus according to claim 1, wherein the print duties vary depending on a length of the print medium for printing in a scanning direction.

18. The method according to claim 6, wherein the conveying unit conveys the print medium backward for printing a part of said one image area between the processes of printing on said one image area by the print head scanned in the forward direction by the scanning unit and conveying the print medium forward by the conveying unit for printing to the another image area.

19. The method according to claim 6, wherein the length of each of the one image area and the another image area in the predetermined direction corresponds to the length of the nozzle array in the predetermined direction.

20. The method according to claim 6, wherein a band area of the print medium with which length in the predetermined direction corresponding to the conveying amount by the conveying unit for conveying the print medium backward is printed by the scanning unit through two scans of the print head.

21. The method according to claim 6, wherein the print head includes a plurality of nozzle arrays each configured to eject a plurality of different colors of inks, and the generation unit generates the print data in such a manner that print duty of the print head for performing said scanning in the forward direction is higher than print duty of the print head for performing said scanning in the backward direction.

22. The method according to claim 6, wherein the generation unit generates print data in such a manner that print duty of the print head for performing said scanning in the forward direction is higher than print duty of the print head for performing said scanning in the backward direction, the print duties being set by a mask pattern for thinning out the image data printed on a print medium and the mask pattern being used in generating print data for printing in a first scan of the print head by the scanning unit.

23. The method according to claim 6, wherein the print duties vary depending on the print medium for printing.

24. The method according to claim 6, wherein the print duties vary depending on a length of the print medium for printing in a scanning direction.

25. The ink jet printing apparatus according to claim 1, wherein the conveying unit conveys the print medium forward along the length corresponding to the length of the nozzle array and conveys the print medium backward along the length corresponding to half the length of the nozzle array.

26. The method according to claim 6, wherein the conveying unit conveys the print medium forward along the length corresponding to the length of the nozzle array and conveys the print medium backward along the length corresponding to half the length of the nozzle array.

* * * * *